US009657462B2

(12) United States Patent
Quarfordt et al.

(10) Patent No.: US 9,657,462 B2
(45) Date of Patent: May 23, 2017

(54) TOOL AND TOOL HOLDER FOR A DREDGER

(71) Applicant: Combi Wear Parts AB, Kristinehamn (SE)

(72) Inventors: Per Quarfordt, Storfors (SE); Adnan Gabela, Kristinehamn (SE); Paull Baghramian, Purmerend (NL); Cornelis Wempe, GA Lunteren (NL); Klaas Wijma, Haarlem (NL)

(73) Assignee: COMBI WEAR PARTS AB, Kristinehamn (SE)

( * ) Notice: Subject to any disclaimer, the term of this patent is extended or adjusted under 35 U.S.C. 154(b) by 0 days.

(21) Appl. No.: 14/404,722

(22) PCT Filed: May 28, 2013

(86) PCT No.: PCT/SE2013/000087
§ 371 (c)(1),
(2) Date: Dec. 1, 2014

(87) PCT Pub. No.: WO2013/180615
PCT Pub. Date: Dec. 5, 2013

(65) Prior Publication Data

US 2015/0159350 A1 Jun. 11, 2015

(30) Foreign Application Priority Data

May 30, 2012 (SE) ..... 1230055

(51) Int. Cl.
*E02F 9/28* (2006.01)

(52) U.S. Cl.
CPC ..... *E02F 9/2808* (2013.01); *E02F 9/2825* (2013.01); *E02F 9/2866* (2013.01); *Y10T 29/49826* (2015.01)

(58) Field of Classification Search
CPC ..... E02F 9/2808; E02F 9/2825; E02F 9/2866; E21C 35/18; E21C 35/1816; E21C 35/183
See application file for complete search history.

(56) References Cited

U.S. PATENT DOCUMENTS 885,930 A 4/1908 Lake
1,226,386 A * 5/1917 Sackett ..... E02F 3/9225 144/219

(Continued)

FOREIGN PATENT DOCUMENTS

CN 102359134 A 2/2012
DE 3531384 A1 3/1987

(Continued)

OTHER PUBLICATIONS

International Search Report and Written Opinion issued Sep. 16, 2013 in PCT/SE2013/000087.

(Continued)

*Primary Examiner* — Jamie L McGowan
(74) *Attorney, Agent, or Firm* — Polsinelli PC

(57) ABSTRACT

A cutter head that comprises at least one blade and at least one adapter chamber arranged in the blade for assembly of a tool holder in the blade, in which the adapter chamber is a cavity located in the blade and having an opening and an assembly recess. Also a blade for a cutter head, as well as a tool holder for assembly on a cutter head for a dredger is included. Moreover, included is a tool arrangement for a dredger. Included also are a method for assembly of a tool holder in a cutter head for a dredger and a production method for a blade for a cutter head for a dredger.

18 Claims, 6 Drawing Sheets

(56) References Cited

U.S. PATENT DOCUMENTS

Figure 1:
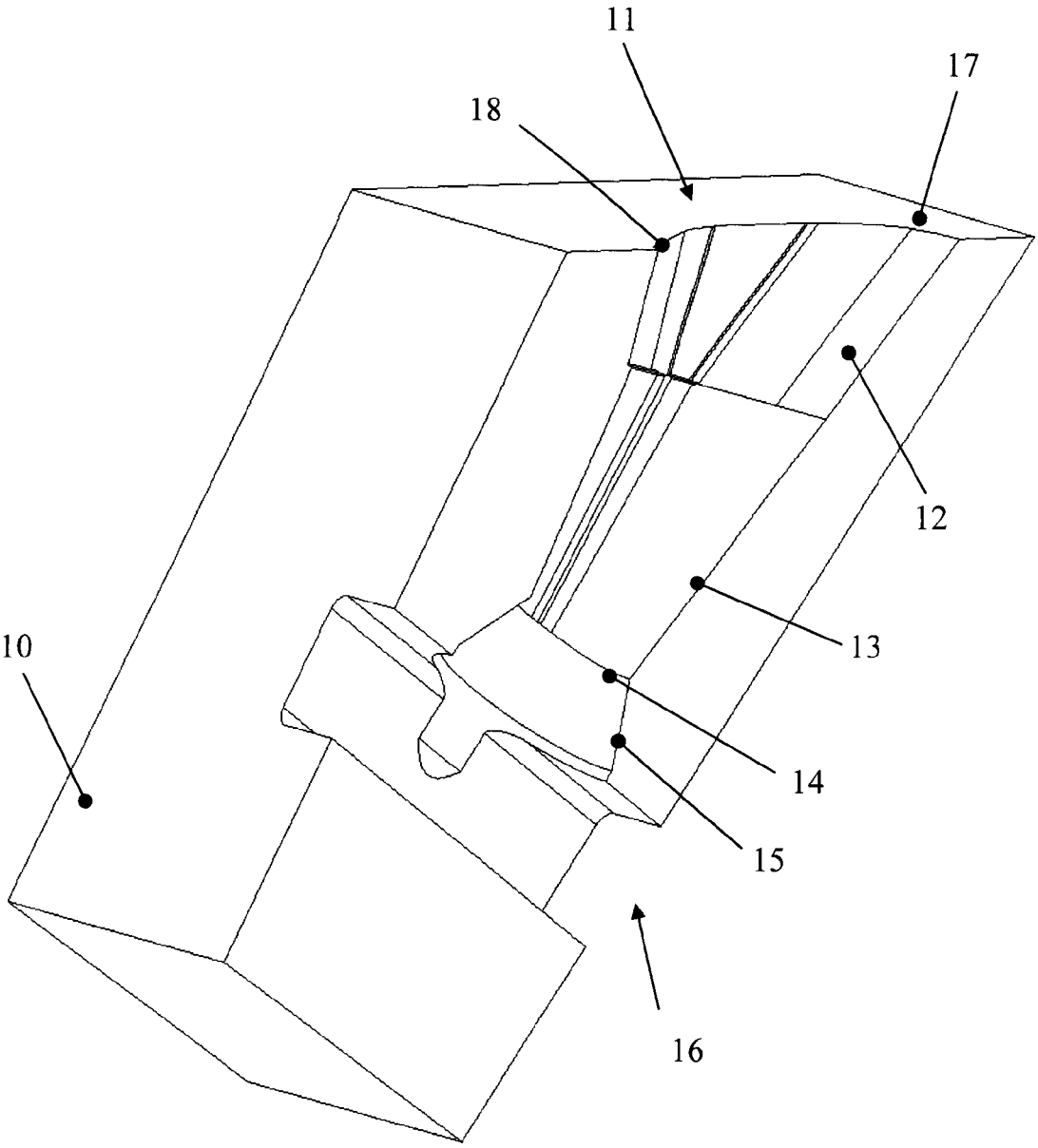

| | | | | |
|---|---|---|---|---|
| 1,316,349 | A * | 9/1919 | Calder | E02F 3/9225 37/328 |
| 2,702,437 | A * | 2/1955 | Cushing | A01B 13/12 198/664 |
| 4,299,424 | A * | 11/1981 | LeBegue | E21C 35/183 299/103 |
| 4,470,210 | A | 9/1984 | Hahn | |
| 4,711,504 | A | 12/1987 | Berchem | |
| 7,234,782 | B2 * | 6/2007 | Stehney | E21C 35/197 299/104 |
| 2005/0268900 | A1 * | 12/2005 | Markley | B28D 1/045 125/14 |
| 2006/0191526 | A1 * | 8/2006 | Markley | B23D 47/02 125/13.01 |
| 2008/0008546 | A1 | 1/2008 | Dietens et al. | |
| 2014/0368023 | A1 * | 12/2014 | Hall | E21C 35/183 299/113 |

FOREIGN PATENT DOCUMENTS

| | | | |
|---|---|---|---|
| DE | 10350604 | A1 | 6/2005 |
| DE | 202008003008 | U1 | 5/2008 |
| GB | 2051184 | A | 1/1981 |
| GB | 2100776 | A | 1/1983 |
| WO | WO-2004092542 | A1 | 10/2004 |

OTHER PUBLICATIONS

"Dredging Equipment" from Ritche Wiki [online], Retrieved from http://www.richiewiki.com/wiki/index.php?title=Dredging &oldid=32727, Sep. 25, 2009.

Supplemental Partial European Search Report issued Jan. 26, 2016 in EP 13798067.

CN Office Action issued Mar. 3, 2016 in CN Appln No. 201380040492.0.

* cited by examiner

TOOL AND TOOL HOLDER FOR A DREDGER

RELATED APPLICATIONS

This application is a national stage application (under 35 U.S.C. §371) of PCT/SE2013/000087, filed May 28, 2013, which claims benefit of Swedish Application 1230055-4, filed May 30, 2012. The entire contents of each application are hereby incorporated by reference.

The present invention relates to a cutter head, and blade, for a dredger, and to an associated tool holder for blades for a dredger. In addition, the invention relates to a tool arrangement on a blade or a cutter head for a dredger. The invention further relates to a method of mounting a tool holder in a cutter head for a dredger. In addition thereto, the invention relates to a production method for blades or the cutter heads for a dredger comprising an adapter chamber.

Devices for dredging are used to displace, dig up or suck up material or sediment wholly or partially in liquid, for example in water. One example of a device for dredging is a dredger. Different types of dredger are designed for different applications and can comprise a large assortment of different mechanical machining methods for displacing, digging up or sucking up the material or the sediment. For example, dredgers can be based on different types of digging methods, such as, for example, different variants of buckets, drilling methods with different types of drills, pneumatic or hydraulic devices, as well as suction devices. Since the material and the sediments are of different nature, hardness and quantity, different methods are required to displace, dig up or suck up the material or the sediment. There are also different reasons for the working of the material or the sediment, wherein the removal of the material is in certain cases desired, such as in the dredging of a canal, for example. Other reasons for dredging are recovery of the material or sediment as raw material, for example the recovery of sand or metals or other substances in sand or other sediment.

For dredgers designed to machine the material or sediment with tools, the tools with which the dredgers are equipped in most cases become worn. The tools are configured to machine in different ways the material or sediment worked by the dredger. The tools are mounted in a tool holder and constantly replaced. Forces acting on the tool affect the tool holder and, after prolonged use, the tool holder may also need to be changed. A rule of thumb is that a tool holder needs to be changed after fifty tools have been worn out. The tool holder can need to be changed, however, before fifty tools are worn out, and the tool holder can also last for a significantly greater number of tools than fifty. Traditionally, the tool holder is welded onto a cutter head. Dredgers equipped with the cutter heads are especially configured for dredging when the material or sediment is of such hardness that mechanical machining is required. A cutter head preferably consists of a number of blades, which preferably, in a spiral shape, pass from the base of the cutter head so as to jointly converge in the tip of the cutter head. On the blades of the cutter head, tool holders with tools are mounted or constructed. The tools are configured to machine the material or sediment worked by the cutter head, and thus the dredger.

The cutter heads for dredgers are often produced by casting, wherein, after the production of the cutter head, a tool holder is mounted on the cutter head. Assembly of the tool holder is preferably realized with welding or other thermal jointing methods. The placement of the tool holders is preferably realized by the assembly of templates or jigs which place and, prior to the assembly, fix the tool on the cutter head. Once the tool holder is temporarily fixed by the template or the jig, then welding of the tool holder onto the cutter head can take place. After the tool holder has been welded onto the cutter head, the template or jig can be disassembled and moved from the cutter head, or to another place on the cutter head, for further assembly of additional tool holders. Once all tool holders have been welded onto the cutter head, the tools can be mounted in the tool holders and the cutter head is ready for use on the dredger.

Patent document U.S. Pat. No. 4,470,210 describes a method and a device for mounting of a tool holder in an adapter, in which the adapter is configured in a spiral blade on a cutter head. A tooth having a tip is mounted on the tool holder, which tooth can be easily replaced in the event of wear, since the tooth is mounted with a lock. The tooth is oriented in the tool holder with two lugs constructed in the tooth. The adapter has a recess in which the tool holder is mounted. The tool holder is mounted against a wall in the adapter and the space between the tool holder and the adapter is expediently filled with epoxy, which, after hardening, temporarily fixes the tool holder in the adapter, whereupon the tool holder is welded to the adapter. In the invention described in patent document U.S. Pat. No. 4,470,210, the change of the tool holder presupposes that the tool holder is fixed with epoxy in the adapter and is welded to the adapter, which involves extensive work by qualified staff on a cutter head removed from the dredger whenever the tool holder or tool holders is/are replaced.

An example of a patent document which describes a tool holder is U.S. Pat. No. 4,337,980. The patent document describes a tool holder in which the tool or the tool holder is mounted with a screw joint in a base member. The base member is, in turn, fixedly mounted on a mining machine, road-making machine or construction machine. The tool holder is mounted in the base member with a screw joint. Both the tool holder and the tools are circularly symmetric. It is proposed that the tool holder can have many different versions of the cross-sectional area of the tool holder in order to fix the tool holder in the base member. The invention described in patent document U.S. Pat. No. 4,337,980 presents a tool holder which is mounted in a base member, in which the base member is in itself mounted on a machine. The base member is arranged free from the machine and the tool holder/the tool is screwed to the base member and the threaded joint is arranged open. The tool holder is suitable for mining machines, road-making machines and construction machines.

Patent document U.S. Pat. No. 2,385,395 describes a device for mounting a tool in the form of an excavating tooth in a tool holder. The excavating tooth has a threaded part or a screw mounted in the excavating tooth, which is mounted with detaining elements in the form of a nut and a wedge. The excavating tooth is mounted on a bucket and the tool holder is a part of the lip of the bucket.

One object of the present invention is to propose a cutter head for a dredger constructed with a recess for mounting of a tool holder, in which the tool holder is mounted with a screw joint and mounting of a tool holder on a dredger can be realized without the tool holder being welded, or otherwise thermally mounted, on the cutter head.

Other objects of the invention are described in greater detail in connection with the detailed description of the invention.

The invention relates to a cutter head for a dredger, in which the cutter head is constructed with at least one blade and at least one adapter chamber is arranged in the blade for assembly of a tool holder in the blade, in which the adapter chamber is a cavity configured in the blade and having an opening and an assembly recess.

According to further aspects of the improved cutter head for a dredger:

the opening of the adapter chamber is made in the edge of the blade, and the extent of the adapter chamber is in the direction along the spine of the blade, the assembly recess is arranged close to the inner end position of the adapter chamber, in which the assembly recess is wholly or partially penetrative of the blade in the direction through the blade spine, the adapter chamber is conically configured and tapered towards the assembly recess.

The invention is further constituted by a blade for a cutter head for a dredger, in which the blade is constructed with at least one adapter chamber, arranged in the blade, for assembly of a tool holder in the blade, in which the adapter chamber is a cavity configured in the blade and having an opening and an assembly recess.

According to further aspects of the improved blade for the cutter heads:

the opening of the adapter chamber is made in the edge of the blade, and the extent of the adapter chamber is in the direction along the spine of the blade, the assembly recess is arranged close to the inner end position of the adapter chamber, in which the assembly recess is wholly or partially penetrative of the blade in the direction through the blade spine, the adapter chamber is conically configured and tapered towards the assembly recess.

The invention is further constituted by a tool holder for assembly on a cutter head for a dredger, in which the tool holder is configured to fit an adapter chamber constructed in the cutter head.

According to further aspects of the improved tool holder for assembly on the cutter heads:

the tool holder is conically configured to fit an adapter chamber constructed in the cutter head, and the tool holder is constructed with a mounting device for assembly of the tool holder on the cutter head, the mounting device of the tool holder, for assembly of the tool holder on the cutter head, is a threaded end piece constructed on the tool holder, the mounting device of the tool holder, for assembly of the tool holder on the cutter head, is an assembly recess, constructed on the tool holder, for a wedge.

The invention is further constituted by a tool arrangement for a dredger, in which at least one tool holder is mounted with a locking mechanism in an adapter chamber constructed on a blade on a cutter head, in which the adapter chamber is a cavity configured in the blade and having an opening and an assembly recess, and in which a tool, for dredging, is mounted on the tool holder.

According to further aspects of the improved tool arrangement for a dredger:

the locking mechanism is a threaded joint, the locking mechanism is a cottered joint, inlays are used between the tools and the tool holder or between the adapter chamber and the tool holder.

The invention is further constituted by a method for assembly of a tool holder in a cutter head for a dredger, in which:

a) the tool holder is mounted and oriented in an opening, made on the cutter head, to an adapter chamber, in which the adapter chamber is constructed in a cavity on a blade on the cutter head, and b) the tool holder is fixed with a locking mechanism which is mounted in an assembly recess configured on the cutter head and constructed on the blade on the cutter head.

The invention is further constituted by a production method for a blade for a cutter head for a dredger, in which an adapter chamber for assembly of a tool holder is machined by:

a) the blade for the cutter head, or the whole of the cutter head, being die-cast with a cavity for an adapter chamber and an assembly recess, b) the blade, or the whole of the cutter head, being mounted, after casting, in a machine tool, c) the bearing surfaces of the adapter chamber being machined with the machine tool.

Figure 2:
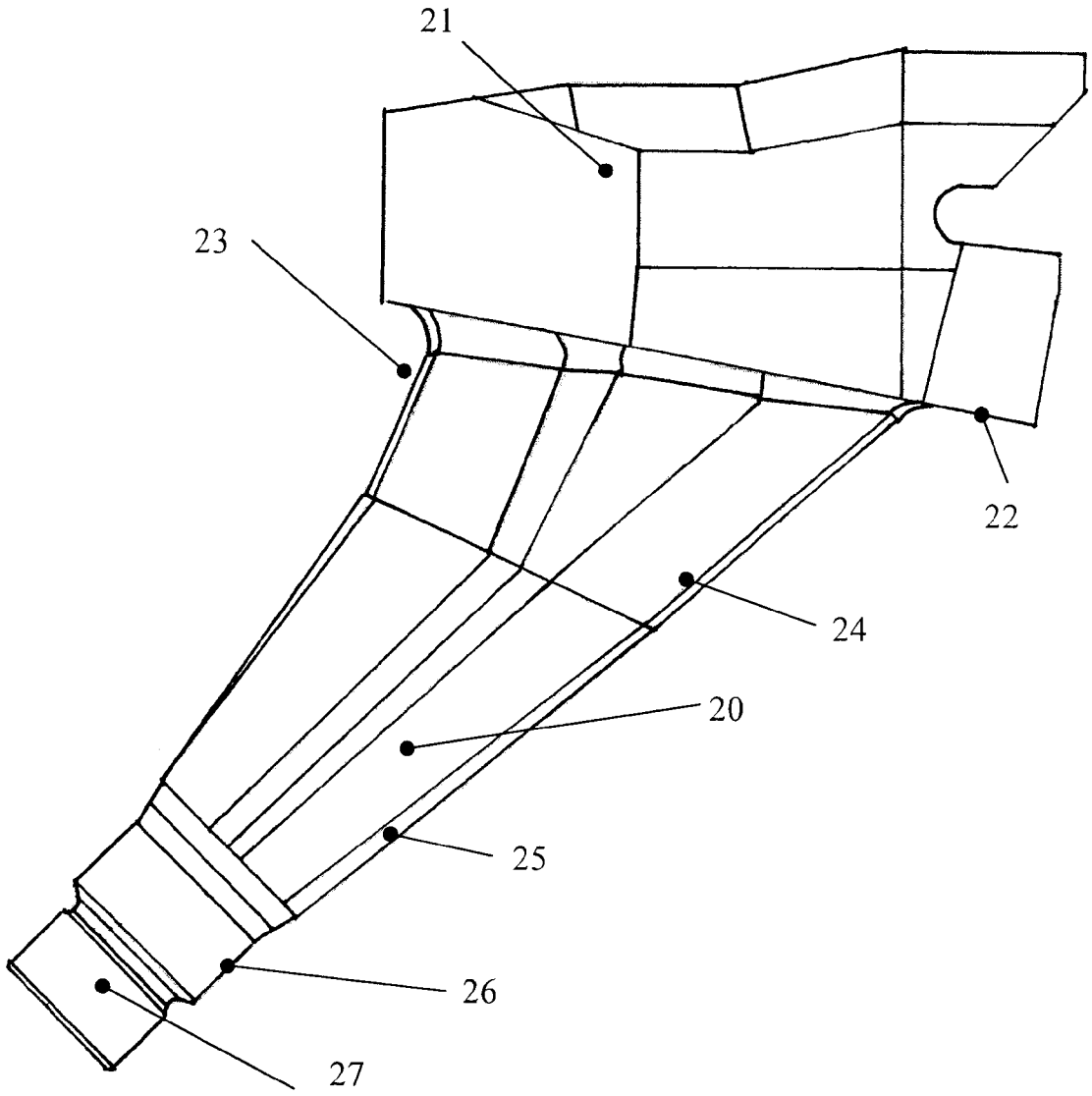
Figure 2A:
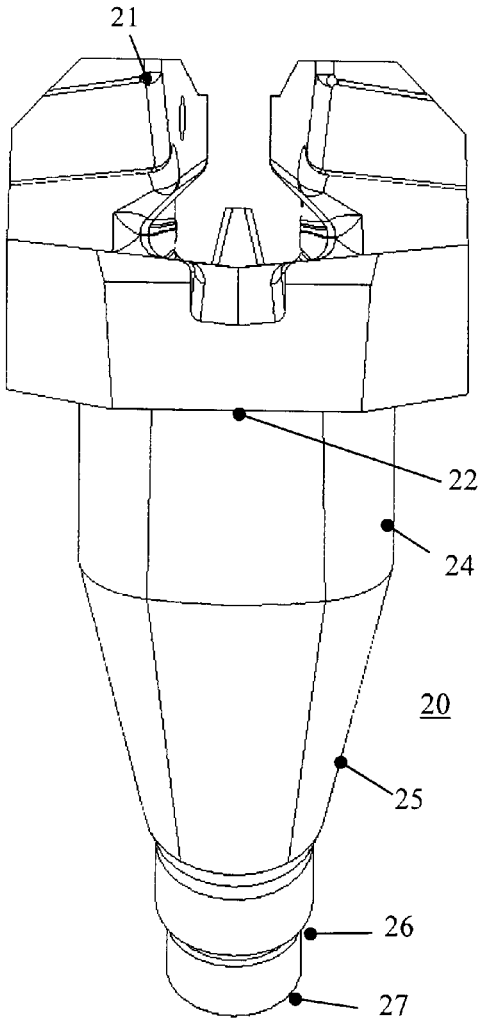
Figure 2B:
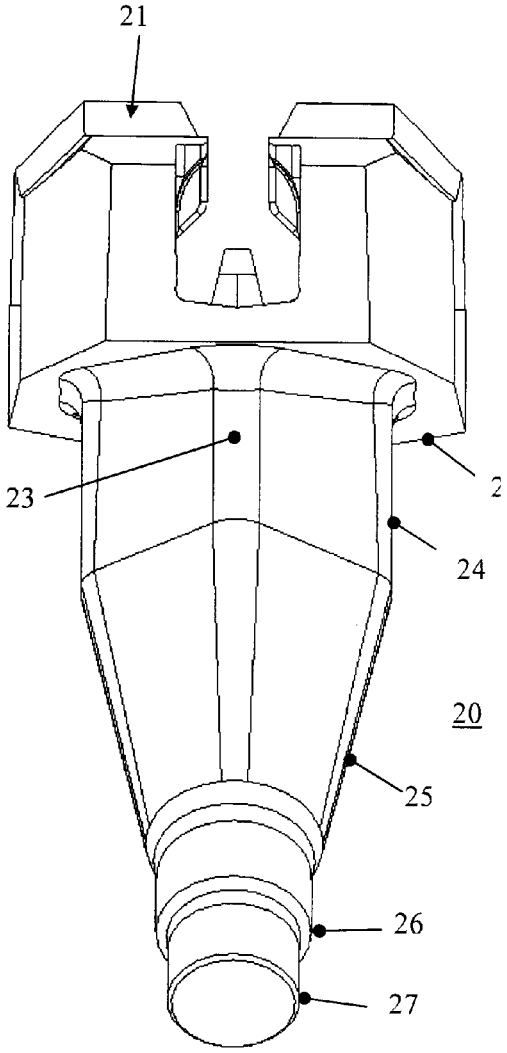
Figure 3:
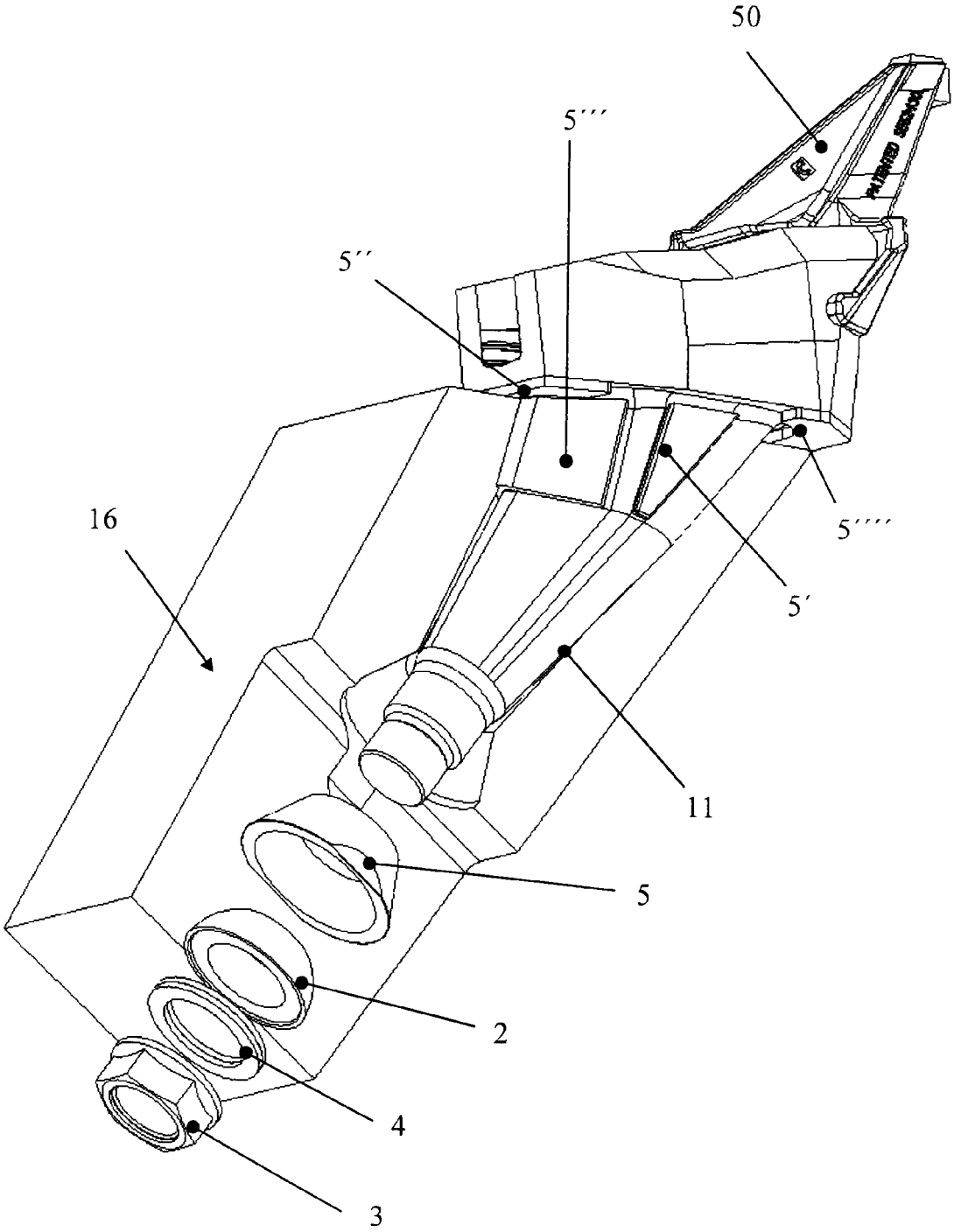
Figure 3A:
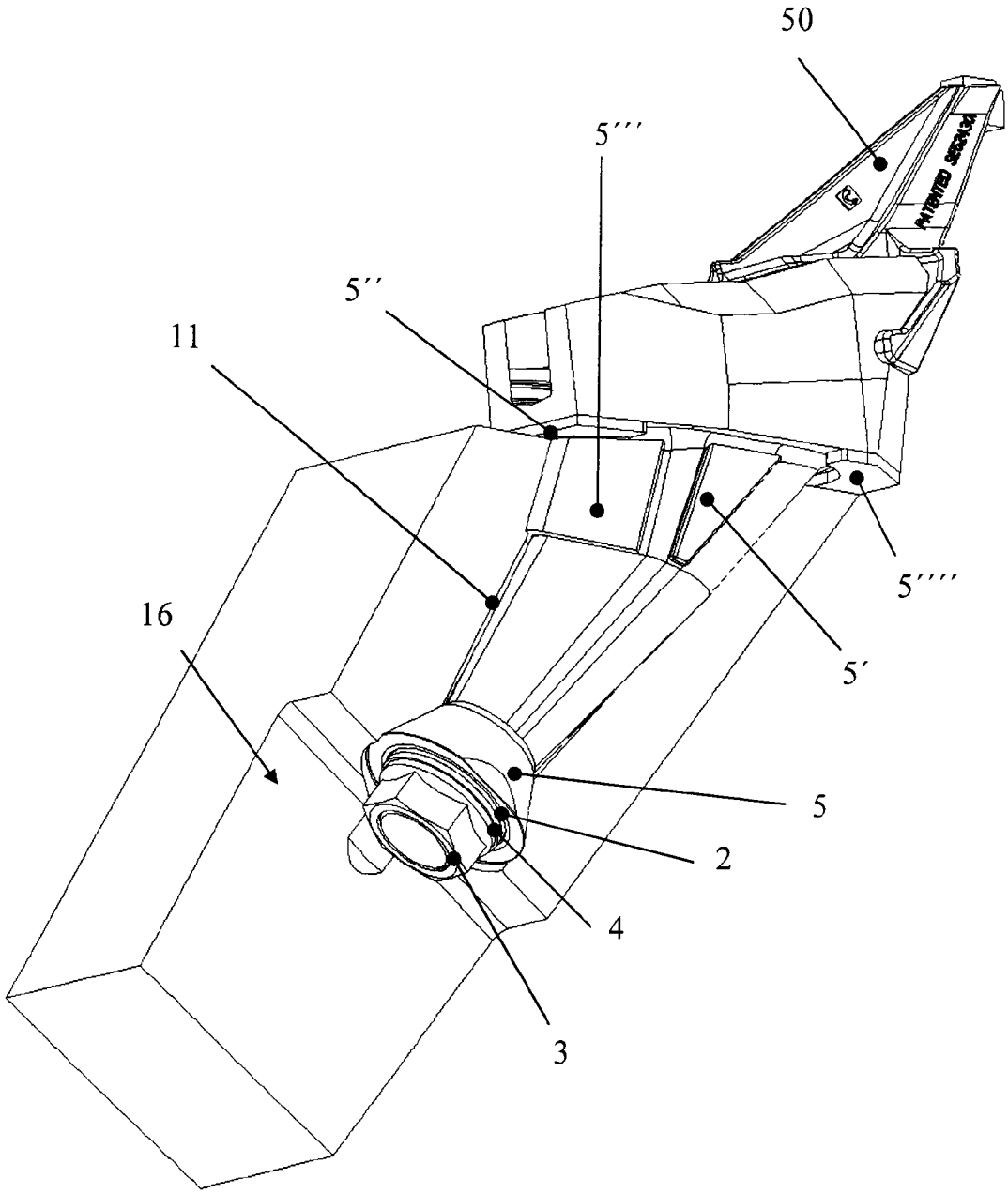
Figure 4:
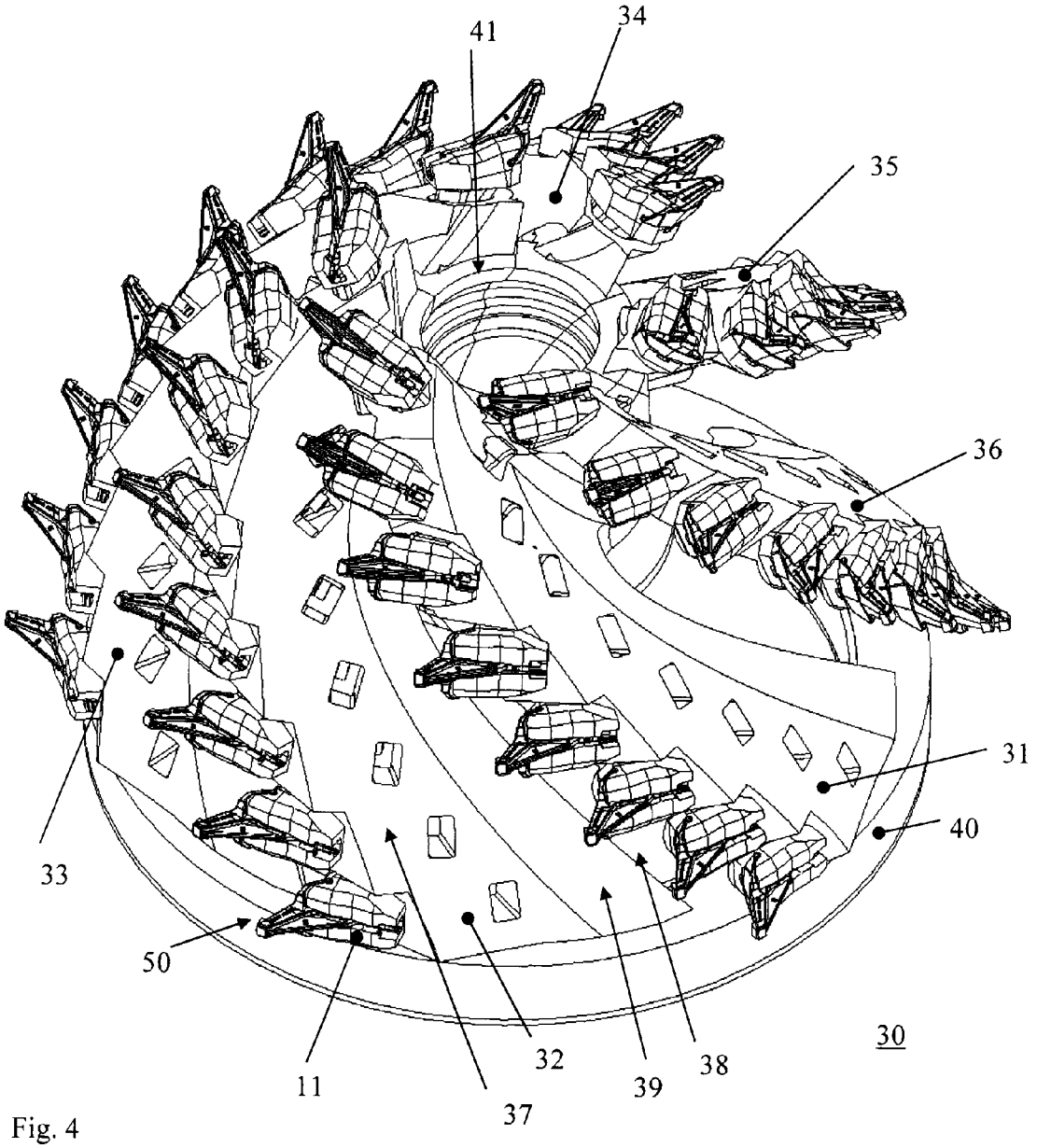

The invention will be described in greater detail below with reference to the appended figures, in which:

FIG. 1 shows a section through an adapter chamber according to one embodiment of the invention, FIG. 2 shows a tool holder according to one embodiment of the invention, FIG. 2*a* and FIG. 2*b* show a tool holder according to one embodiment of the invention in a different view, FIG. 3 shows an exploded diagram relating to an adapter chamber in section, with tool holder and mounting device according to one embodiment of the invention, FIG. 3*a* shows an adapter chamber in section, with tool holder and mounting device according to one embodiment of the invention, FIG. 4 shows a cutter head for a dredger with mounted tool according to one embodiment of the invention.

On the cutter head 30 of the dredger, also referred to as the cutting head, one or more adapter chambers 11 are constructed on one of the blades 10 of the cutter head. A cutter head 30 has a number of blades 10 or arms, which are mounted in part in a hub 41, in the tip of the cutter head, and in part in a ring 40 in the base of the cutter head. The blades 10 are gathered in the hub 41 and the hub 41 is preferably constructed with a thread for assembly of the cutter head 30 in the dredger and for force transfer from the dredger to the cutter head 30. Normally a cutter head 30 for a dredger consists of an even number of blades 10, in which two different versions of the blades are found. Where two different blades are used, the two different blades have separate positioning of the adapter chamber 11, and thus also separate positioning of the tools 50, also referred to as the teeth, in order that the cutter head 30 shall acquire a suitable construction for machining. On each blade is arranged a number of tools 50 and tool holders 20 for working of the material or sediment which the cutter head is meant to machine. The blades on the cutter head 30 give rise to the formation of a number of openings 39 between the individual blades 31, 32, 33, 34, 35, 36 on the cutter head, in which openings the sediment or dredged material which is machined can be evacuated or otherwise transported away from the cutter head and thus the machining zone. Each blade has a spine 37 and an edge 38 which is directed towards the machining direction for the cutter head.

In FIG. 1 is shown a section through one of the embodiments of the adapter chamber 11. The adapter chamber 11 is constructed on the blades 10, also referred to as arms, of the cutter head 30. A cutter head 30 preferably has a plurality of adapter chambers 11. The adapter chamber 11 is cast, machined or otherwise formed onto the cutter head. Preferably, an adapter chamber is cast onto the blade of the cutter head and the whole of the blade or the cutter head is subsequently machined in a metal-cutting machine, preferably a drilling and milling machine or multi-operation milling cutter. The purpose of the adapter chamber 11 is to orient and/or detain a tool holder 20 on the cutter head 30. The adapter chamber has an opening in which the tool holder is mounted in the adapter chamber 11. The adapter chamber has a conical and circularly symmetric surface 13 for receiving the conical portion 25 of the tool holder 20. Between the surface 25 of the tool holder and the surface 13 of the adapter chamber there is preferably clearance. In addition, the adapter chamber has a cylindrical portion 14 for admission of the mounting device 27 of the tool holder. The mounting device 27 can be, for example, cotters or wedges, but is preferably a threaded joint. Mounting of the tool holder 20 in the adapter chamber is realized by virtue of an assembly recess 16, which is constructed perpendicularly in the end position of the adapter chamber 11. The assembly recess 16 is wholly or partially penetrative of the blade 10 of the cutter head 30. Where the tool holder is longer than the width of the blade, the assembly recess will be on the rear side of the blade, that is to say the opposite side to the edge of the blade. Through the placement of the assembly recess, the assembly recess can also protect the mounting device 27 and the mounting elements from the environment. The adapter chamber thus has an opening for the tool holder and a separate opening for the assembly recess. The assembly recess 16 can also be protected, wholly or partially, with, for example, different types of caps, rubber plugs or the like. In the assembly recess 16 is found an assembly support 15, against which a cone 2 can be brought to bear. The adapter chamber is constructed with supports in order to bear the radial and axial forces acting on the tool and thus the tool holder. As a result of the fastening of the tool holder in the adapter chamber, the radial and axial forces will be transmitted to the adapter chamber 11. The adapter chamber 11 is constructed with a rear support 18, against which the radial forces principally act. In addition, the adapter chamber is constructed with a front support 17, against which the axial forces principally act. Apart from the front support 17 and the rear support 18, together referred to as upper supports, large parts of the forces acting on the tool holder 20 are also transmitted towards the circular symmetric surface 12 of the adapter chamber 11. The adapter chamber is constructed perpendicular or virtually perpendicular to the blade 10 on the edge 38 of the cutter head 30. The angling of the adapter chamber to the edge 38 can be varied along the edge 38 of the blade 10 in the longitudinal direction of the blade in order to obtain an advantageous construction of the tools which is adapted according to the field of application of the cutter head 30. Through the construction of the upper supports 17, 18 of the adapter chamber 11, the tool holder 20 will be oriented in the adapter chamber, so that possible problems with incorrect assembly of the tool holder 20 in the adapter chamber 11 can be avoided. In this way, less qualified staff can be used to mount a tool holder on the blade and the cutter head compared with the case where the tool holder is welded onto the blade and the cutter head.

In FIG. 2 is shown an embodiment of the tool holder 20, also referred to as an adapter or a mechanical adapter, in which a tool 50, such as, for example, a tooth or excavating tooth, is mounted in a position 21. The tool 50 is the wearing part which meets the material machined by the dredger. The tool holder 20 has a number of surfaces 22, 23, 24, 25, 26, which orient the tool holder 20 in the adapter chamber 11 and transfer to the adapter chamber 11 the forces which act on the tool holder, and thus the forces which act on the tools 50 mounted on the cutter head 30 of the dredger. The rear surface 23 of the tool holder principally transfers the radial forces to which the tool 50 is exposed. The front surface 22 of the tool holder principally transfers the axial forces to which the tool 50 is exposed. The remaining surfaces 24 and 26 of the tool holder transfer other forces acting on the tool holder to the adapter chamber. The mounting device 27 of the tool holder is admitted by the cylindrical portion 14 of the adapter chamber and corresponding cylindrical pins 26 constructed on the tool holder. The mounting device 27, the assembly support 15, cone 2, the washer 4 and the nut 3, also referred to as the mounting elements, also absorb a part of the forces which the tool 50 transfers to the tool holder 20, and thus to the adapter chamber 11 on the blades 10 of the cutter head 30.

In FIG. 2*a* and FIG. 2*b* are shown further views relating to the tool holder 20, in which is shown the bearing surface 28, which is that surface on the tool holder which bears against the blade 10 and with which the tool holder 20 is placed against the blades 10 of the cutter head 30. The bearing surface 28 also absorbs the axial forces which act on the blade 10 through the tool holder 20.

In FIG. 3 is shown an exploded diagram of the tool holder 20 in an adapter chamber 11, as well as mounting elements in the form of a cone 2, nut 3 and washer 4. The mounting elements are tailored to the mounting device 27 and according to the purpose chosen for distinct assembly of the tool holder 20 in the adapter chamber 11. The mounting device 27 of the tool holder 20 is expediently provided with threads and is mounted with cone 2 and nut 3 through an assembly recess 16. Assembly of the tool holder 20 in the adapter chamber is realized by the tool holder 20 being placed in the adapter chamber, by the surfaces 22, 23, 24, 25, 26 and 28 of the tool holder being oriented towards and meeting the surfaces 12, 13, 14, 17 and 18 of the adapter chamber. When the surfaces of the tool holder meet the adapter chamber 11, then the tool is oriented in place and the mounting device 27 of the tool holder is accessible in the assembly recess 16. Where the mounting device 27 is a threaded joint, the mounting device 27 is screwed with the nut 3, washer 4 and a cone 2. The cone 2 is mounted against the assembly support 15 of the adapter chamber. The nut is tightened with a purpose-built tool, preferably the nut is tightened with a hydraulic or pneumatic tool to a predefined torque. Between the nut 3 and the cone 2, also referred to as a wedge, a washer 4 can be mounted. The washer 4 can be of the type locking washer, rubber washer or other types of washers. The tool holder 20 can also be welded into the adapter chamber 11 if, for example, the threaded joint is damaged, or for other reasons when welding is considered a better technical solution for fixing the tool holder in the adapter chamber.

Various types of inlays, also referred to as liners or inserts, 5, 5', 5", 5''', 5'''' can be used to absorb forces between the tool holder 20 and the adapter chamber 11 and/or between the tool 50 and the tool holder 20. By adapting the choice of material for the inlays, the wear can be shifted from the tools, and the tool holder, so that the inlays become worn first. In an advantageous embodiment, the inlays 5, 5', 5", 5''', 5'''' can be made of a material which is softer than the tool 50 but harder than the tool holder 20. In addition, the inlays can act as supporting parts for worn tools or tool holders, so that the tools and the tool holders can be used longer and can thus acquire a longer service life. The inlays 5, 5', 5", 5''', 5'''' are preferably used on surfaces which are exposed to high surface pressure and the inlays become deformed during use and are replaced when worn out. They are worn out once the extent of the deformation is such that the inlays 5, 5', 5", 5''', 5''' no longer fulfil their function. The inlays 5, 5', 5", 5''', 5'''' are preferably produced in a number of standard dimensions and are adapted according to how wear is generated between the tool 50 and the tool holder 20 and between the tool holder 20 and the adapter chamber 11. The inlays 5, 5', 5", 5''', 5'''' are expediently mounted with mechanical connection, for example screw joints, spot-welded, glued or otherwise mounted in their correct position. The inlays 5, 5', 5", 5''', 5'''' can also be placed in their correct position without fixing.

In FIG. 3*a*, the tool holder is shown with the mounting elements mounted when the mounting elements are a threaded joint.

In FIG. 4 is shown a cutter head 30 for a dredger, in the shown example the cutter head 30 having six blades, but a different number of blades can be present, depending on the field of application of the dredger and thus of the cutter head. The six individual blades are 31, 32, 33, 34, 35 and 36. Preferably, a cutter head is produced by a number of blades being joined together in a hub 41 and a ring 40. The hub 41 is constructed with threads or some other arrangement for assembly of the cutter head on the dredger. The hub 41 can also be constructed directly in the blades, which, once the blades have been welded together, form threads. Smaller cutter heads can be produced by the cutter head being cast in one piece and subsequently machined, whilst, for larger cutter heads, the blades 31, 32, 33, 34, 35, 36, hub 41 and ring 40 are produced individually. The choices of material in respect of the components are preferably made to enable them to be easily welded or otherwise thermally joined together. On the cutter head are mounted a number of tool holders 20 and a number of tools 50. The number of tools, and thus the number of tool holders, varies, depending on the field of application of the cutter head. Each blade has a blade spine 37 and an edge 38. The adapter chamber 11 extends from the edge 38 of the blade along the blade spine 37. A blade 10, 31, 32, 33, 34, 35, 36 moves in the shape of a spiral from where the blade is mounted in the base of the cutter head in the ring 40 to the tip of the cutter head where the blades are mounted in the hub 41. The construction of the blade is adapted according to the construction of the cutter head. The blades are cast individually and adapter recesses are prepared in the casting process and machined after the casting. It is principally the upper bearing surfaces 12, 17 and 18 of the adapter recesses which are machine-cut after casting in order to provide good orientation of the tool holder, and thus the tool in the blade and thus the cutter head. The bearing surfaces are machined with a machine tool, such as, for example, a multi-operation machine or a drilling and milling machine.

The tool holders are mounted in the cutter head by placement of the tool holder 20 into a suitable adapter chamber 11. As a result of the construction of the adapter chamber, the tool holder will be oriented by the bearing surfaces 12, 17, 18 and the correspondingly oriented surfaces 22, 23, 24, 28 of the tool holder. Once the tool holder is correctly positioned, the mounting device 27 will also become visible in the assembly recess 16. On the mounting device, the cone 2, the washer 4 and, finally, the nut 3 can then be mounted. Where a wedge (not shown in the figures) has been used, then the recess of the mounting device for a wedge will be visible in the assembly recess. The wedge is subsequently placed in the mounting device 27 and forced with suitable equipment, for example a sledge hammer, so that the wedge locks the tool holder 20 in place in the adapter chamber 11. The wedge-based assembly method is referred to as a cottered joint. Where a threaded joint is used, then the nut 3 is screwed with suitable equipment, for example a hydraulic or pneumatic nut tightener, to a predefined torque. Where no pneumatic or hydraulic nut tightener is present, a suitable ratchet handle or other equipment is used to tighten the nut 3 to a suitable torque. The tool holders can be mounted and replaced once the cutter head is mounted on the dredger. The positioning of the tool holders can be realized with great accuracy when the adapter chamber is machined for a good fit, especially compared with the case in which the tool holders are welded onto the blades. When no welding or cutting of the tool holders takes place, the change of tool holder becomes more environmentally friendly. Welding/cutting requires gases, which can be avoided if the tool holders are mounted with a cottered or threaded joint. The tool holders can also be easily removed from the cutter head and repaired in order to further prolong the service life. Where the tool holders are cut away from the cutter head, then this very often results in the discarding of the tool holders.

In one example of the construction of a cutter head for a dredger, the cutter head has 6 blades, whilst 5 or 7 blades are also commonly found, in addition to which cutter heads for dredgers having a different number of blades are also found. The usual number of teeth on the cutter head, and thus also the number of tool holders, is 60. The number of teeth can be freely varied, however, depending on the application, dredger construction, or depending on the nature of the dredged material. The tool holder is often mounted with nuts in the order of magnitude of M60, but can be arbitrarily varied according to application, dredger construction, or depending on the nature of the dredged material or the construction of the tools and tool holders. Following assembly of the tool holders, the tools are mounted into the tool holders.

The invention claimed is:

1. Cutter head for a dredger, wherein the cutter head comprises at least one blade, where the blade is mounted in part in a hub in a tip of the cutter head, and in part in a ring in a base of the cutter head and wherein at least one adapter chamber is arranged in the blade for assembly of a tool holder in the blade, in which the adapter chamber is a cavity configured in the blade and having an opening and an assembly recess, wherein the assembly recess is located close to the inner end position of the adapter chamber, in which the assembly recess is wholly or partially penetrative of the blade in the direction through a spine of the blade.

2. Cutter head for a dredger according to claim 1, wherein the opening of the adapter chamber is made in an edge of the blade and wherein the extent of the adapter chamber is in the direction along a spine of the blade.

3. Cutter head for a dredger according to claim 2, wherein the adapter chamber is conical and tapered towards the assembly recess.

4. Cutter head for a dredger according to claim 1, wherein the adapter chamber is conical and tapered towards the assembly recess.

5. Blade for a cutter head for a dredger, wherein the blade is mounted in part in a hub in a tip of the cutter head, and in part in a ring in a base of the cutter head, and comprises at least one adapter chamber, arranged in the blade, for assembly of a tool holder in the blade, in which the adapter chamber is a cavity configured in the blade and having an opening and an assembly recess, wherein the assembly recess is located close to the inner end position of the adapter chamber, in which the assembly recess is wholly or partially penetrative of the blade in the direction through a spine of the blade.

6. Blade for a cutter head for a dredger according to claim 5, wherein the opening of the adapter chamber is made in an edge of the blade, and wherein the extent of the adapter chamber is in the direction along a spine of the blade.

7. Blade for a cutter head for a dredger according to claim 6, wherein the adapter chamber is conical and tapered towards the assembly recess.

8. Tool holder for assembly on a cutter head for a dredger, wherein the tool holder is conical to thereby fit an adapter chamber located in the cutter head, where the adapter chamber is located on one of the blade, where the blade is mounted in part in a hub in a tip of the cutter head, and in part in a ring in a base of the cutter head, and wherein the tool holder comprises a mounting device for assembly of the tool holder on the cutter head, wherein the mounting device of the tool holder, for assembly of the tool holder on the cutter head, is an assembly recess, located on the tool holder, for a wedge and wherein the assembly recess is located close to the inner end position of the adapter chamber, in which the assembly recess is wholly or partially penetrative of the blade in the direction through a spine of the blade.

9. Tool holder for assembly on a cutter head for a dredger according to claim 8, wherein the mounting device of the tool holder, for assembly of the tool holder on the cutter head, is a threaded end piece located on the tool holder.

10. Tool arrangement for a dredger, wherein at least one tool holder is mounted with a locking mechanism in an adapter chamber located on a blade on a cutter head, where the blade is mounted in part in a hub, in a tip of the cutter head, and in part in a ring in a base of the cutter head in which the adapter chamber is a cavity located in the blade and having an opening and an assembly recess, wherein the assembly recess is located close to the inner end position of the adapter chamber, in which the assembly recess is wholly or partially penetrative of the blade in the direction through a spine of the blade and wherein a tool, for dredging, is mounted on the tool holder.

11. Tool arrangement for a dredger according to claim 10, wherein the locking mechanism is a threaded joint.

12. Tool arrangement for a dredger according to claim 10, wherein the locking mechanism is a cottered joint.

13. Tool arrangement for a dredger according to claim 10, wherein inlays located between the tools and the tool holder or between the adapter chamber and the tool holder.

14. Tool arrangement for a dredger according to claim 10, wherein the opening of the adapter chamber is made in an edge of the blade and wherein the extent of the adapter chamber is in the direction along the spine of the blade and wherein the adapter chamber is conical and tapered towards the assembly recess.

15. Method for assembly of a tool holder in a cutter head for a dredger, wherein:

a) the tool holder is mounted and oriented in an opening, located on the cutter head, to an adapter chamber, in which the adapter chamber is located in a cavity on a blade on the cutter head, wherein the blade is mounted in part in a hub in a tip of the cutter head, and in part in a ring in a base of the cutter head and, b) wherein the tool holder is fixed with a locking mechanism which is mounted in an assembly recess configured on the cutter head and located on the blade on the cutter head, wherein the assembly recess is located close to the inner end position of the adapter chamber, in which the assembly recess is wholly or partially penetrative of the blade in the direction through a spine of the blade.

16. Method for assembly of a tool holder in a cutter head for a dredger according to claim 15, wherein the opening of the adapter chamber is made in an edge of the blade and wherein the extent of the adapter chamber is in the direction along the spine of the blade and wherein the adapter chamber is conical and tapered towards the assembly recess.

17. Production method for a blade for a cutter head for a dredger, wherein the blade is mounted in part in a hub in a tip of the cutter head, and in part in a ring in a base of the cutter head wherein an adapter chamber for assembly of a tool holder is machined by:

a) the blade for the cutter head, or the whole of the cutter head, being die-cast with a cavity for an adapter chamber and an assembly recess, wherein the assembly recess is located close to the inner end position of the adapter chamber, in which the assembly recess is wholly or partially penetrative of the blade in the direction through a spine of the blade, b) the blade, or the whole of the cutter head, being mounted, after casting, in a machine tool, and c) the bearing surfaces of the adapter chamber being machined with the machine tool.

18. Production method for a blade for a cutter head for a dredger according to claim 17, wherein the opening of the adapter chamber is made in an edge of the blade and wherein the extent of the adapter chamber is in the direction along the spine of the blade and wherein the adapter chamber is conical and tapered towards the assembly recess.

* * * * *